US006183132B1

(12) United States Patent
Simhaee

(10) Patent No.: US 6,183,132 B1
(45) Date of Patent: Feb. 6, 2001

(54) REFUSE BAGS WITH INTEGRAL TIES AND METHOD OF MANUFACTURE

(76) Inventor: Ebrahim Simhaee, 112 N. Maple Dr., Beverly Hills, CA (US) 90210

( * ) Notice: Under 35 U.S.C. 154(b), the term of this patent shall be extended for 0 days.

(21) Appl. No.: 09/455,510

(22) Filed: Dec. 3, 1999

(51) Int. Cl.[7] ..... B65D 30/00
(52) U.S. Cl. ..... 383/37; 383/77; 383/120
(58) Field of Search ..... 383/8, 37, 77, 383/120

(56) References Cited

U.S. PATENT DOCUMENTS

| | | | | |
|---|---|---|---|---|
| 1,236,285 | | 8/1917 | Gallie . | |
| 3,052,399 | | 9/1962 | Brown | 229/85 |
| 3,140,815 | | 7/1964 | Majesky | 229/66 |
| 3,186,626 | | 6/1965 | Shvetz | 229/62 |
| 3,217,971 | | 11/1965 | Shvetz | 229/62 |
| 3,674,135 | | 7/1972 | Simon | 206/58 |
| 3,774,838 | | 11/1973 | Christie | 229/62 |
| 3,931,886 | | 1/1976 | Yamauchi | 206/390 |
| 3,961,743 | | 6/1976 | Hollowell | 229/62 |
| 4,164,170 | | 8/1979 | Nordin | 93/35 |
| 4,312,392 | | 1/1982 | Sekiguchi | 150/3 |
| 4,345,712 | | 8/1982 | Gim | 229/62 |
| 4,445,230 | | 4/1984 | Spadaro | 383/7 |
| 4,562,925 | * | 1/1986 | Pistner | 383/8 X |
| 4,709,400 | | 11/1987 | Bruno | 383/77 |
| 4,759,742 | | 7/1988 | Achelpohl | 493/195 |
| 4,790,437 | * | 12/1988 | Pistner | 383/8 X |
| 4,846,349 | * | 7/1989 | Galimberti | 383/8 X |
| 4,859,082 | * | 8/1989 | Llorens et al. | 383/8 |
| 5,041,317 | | 8/1991 | Greyvenstein | 428/35.5 |
| 5,246,110 | | 9/1993 | Greyvenstein | 206/390 |
| 5,415,475 | * | 5/1995 | Sandy | 383/77 X |
| 5,564,223 | | 10/1996 | Takita | 47/26 |
| 5,611,627 | | 3/1997 | Belias et al. | 383/37 |
| 5,683,340 | | 11/1997 | Belias et al. | 493/195 |
| 5,720,557 | | 2/1998 | Simonsen | 383/61 |
| 5,908,244 | | 6/1999 | Galambos | 383/8 |

FOREIGN PATENT DOCUMENTS

| | | | | |
|---|---|---|---|---|
| 0 541 028 | * | 5/1993 | (EP) | 383/37 |
| 2 469 355 | * | 5/1981 | (FR) | 383/8 |
| 2 632 274 | * | 12/1989 | (FR) | 383/77 |
| 2 208 843 | * | 4/1989 | (GB) | 383/77 |

* cited by examiner

*Primary Examiner*—Jes F. Pascua
(74) *Attorney, Agent, or Firm*—Darby & Darby

(57) ABSTRACT

A roll of plastic refuse bags comprises a fully gussetted, tubular form folded longitudinally to form a star seal configuration. The individual bags are separated by separation lines which form the open ends of the bags and welds which form the closed ends of the bags. A tie cut-out region is formed in each bag along one of the longitudinal edges beneath the separation line so that when an individual bag is separated from the roll and opened, four ties are formed which can be used to tie the bag closed.

4 Claims, 4 Drawing Sheets

FIG. 3A
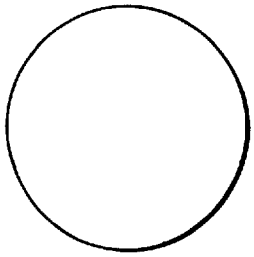
FIG. 3B
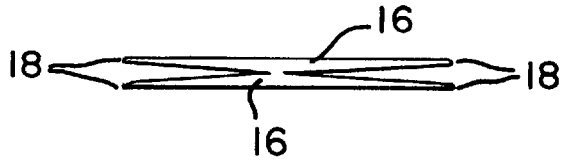
FIG. 3C
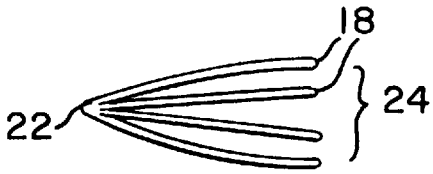
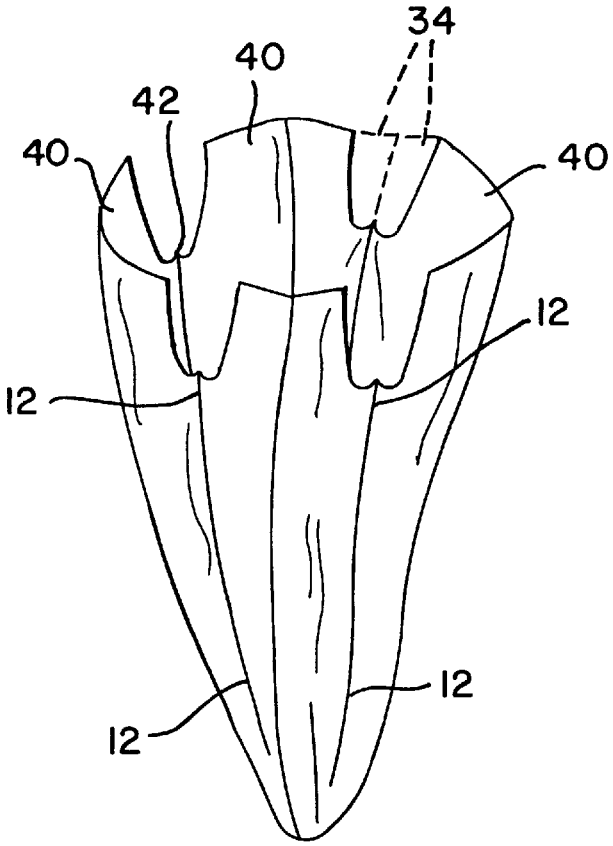
FIG. 4

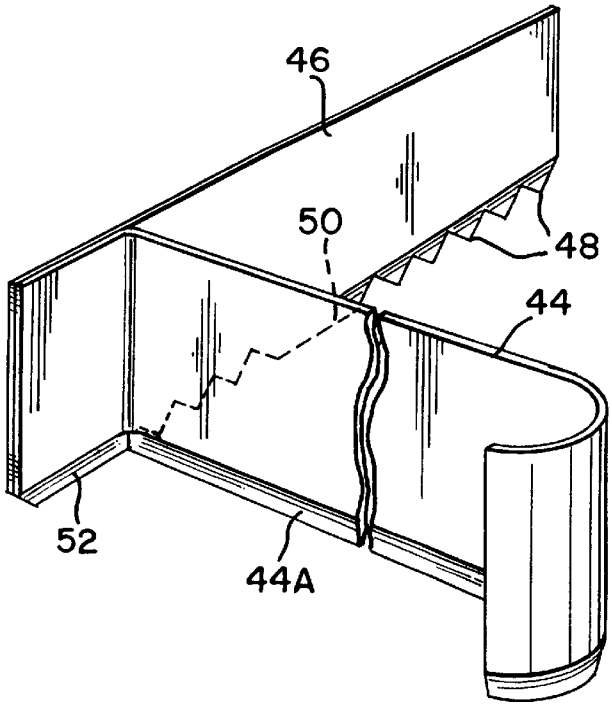
FIG. 5
FIG. 6
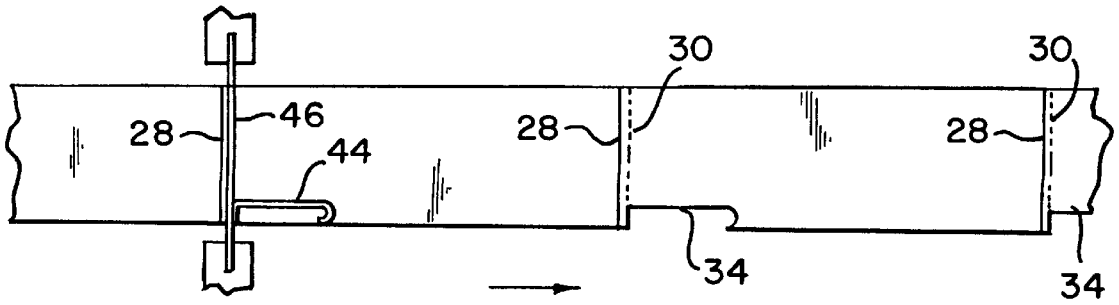

REFUSE BAGS WITH INTEGRAL TIES AND METHOD OF MANUFACTURE

This invention relates to plastic bags and, more specifically, to plastic bags which are intended to be used as refuse bags.

BACKGROUND OF THE INVENTION

Plastic bags are commonly used for holding refuse and other material. Such bags come in various forms. One common bag is manufactured from an extruded tube of plastic, typically polyethylene, which includes a multiplicity of heat sealed welds and perforated separation lines separating the individual bags. The tube of plastic is gussetted, folded, and wound into a roll so that individual bags can be dispensed one at a time by tearing the leading bag from the roll at a perforated separation line.

In the case of a refuse bag, it is often desirable to secure the contents by tying the bag after it has been filled. Separate ties or straps may be provided for this purpose but this is not optimal since the ties can be misplaced and it is often cumbersome to hold a full bag while attempting to apply the tie.

A number of attempts have been made to provide a plastic refuse bag which is formed in such a way that the bag itself includes integral flaps or ties which can be used to tie the bag closed. Representative examples of such constructions are shown in Gim U.S. Pat. No. 4,345,712 and Greyvenstein U.S. Pat. No. 5,246,110.

The present invention provides a roll of plastic bags which are easily dispensed and opened, and which include integrally formed portions at their open ends which can be used to tie the bag after it has been filled.

SUMMARY OF THE INVENTION

A roll of plastic bags comprises a tubular web having a series of seals which form the bottoms of a series of bags, and adjacent separation lines which form the open ends of the bags. Each bag includes a tie cut-out region extending from the separation line along at least one edge of the web so that when the individual bags are dispensed, the upper portions of the bag form flaps or ties which can be used to tie the bags closed.

The method of making the bags comprises extruding a tubular form, fully gussetting the form, and, optionally, folding the fully gussetted web to form a star seal configuration. The web is sealed at predetermined intervals and separation lines are cut into the web adjacent the seal so that individual bags can be separated from the web. In accordance with the invention, a tie cut-out region is formed in each bag immediately beneath each separation line so that when a bag is separated from the web, the open end of the bag will include two or more ties which can be used to close the bag after it has been filled.

IN THE DRAWINGS

FIGS. 1A and 1B schematically illustrate the process used to manufacture plastic bags in accordance with the invention;

FIG. 3A is a cross sectional view of the web along the line 3A—3A of FIG. 2A;

FIG. 3B is a cross sectional view of the web along the line 3B—3B of FIG. 2A; and FIG. 3C is a cross sectional view of the web along the line 3C—3C of FIG. 2A with the individual plies being separated for purposes of illustration;

FIG. 4 is a is a perspective view of a plastic bag after it has been separated from the roll and opened, illustrating the ties formed in accordance with the invention.

FIG. 5, is a perspective view of a tool which can be used to simultaneously form a perforated separation line and remove the tie cut-out region;

FIG. 6 is a top view illustrating schematically the tool shown in FIG. 5 in its operating position;

DETAILED DESCRIPTION

The refuse bag of this invention is structurally similar to the produce bags illustrated in U.S. Pat. No. 5,558,262 which is hereby incorporated by reference into this specification.

Figure 1A:
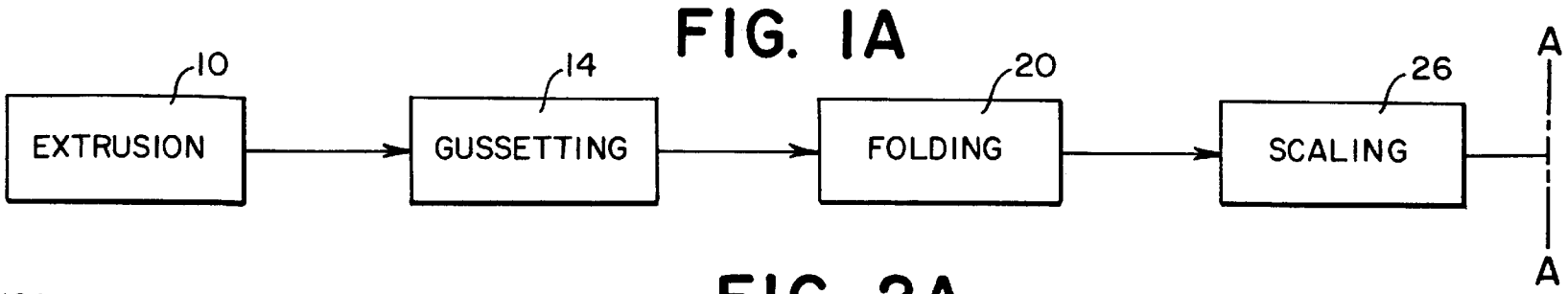
Figure 2A:
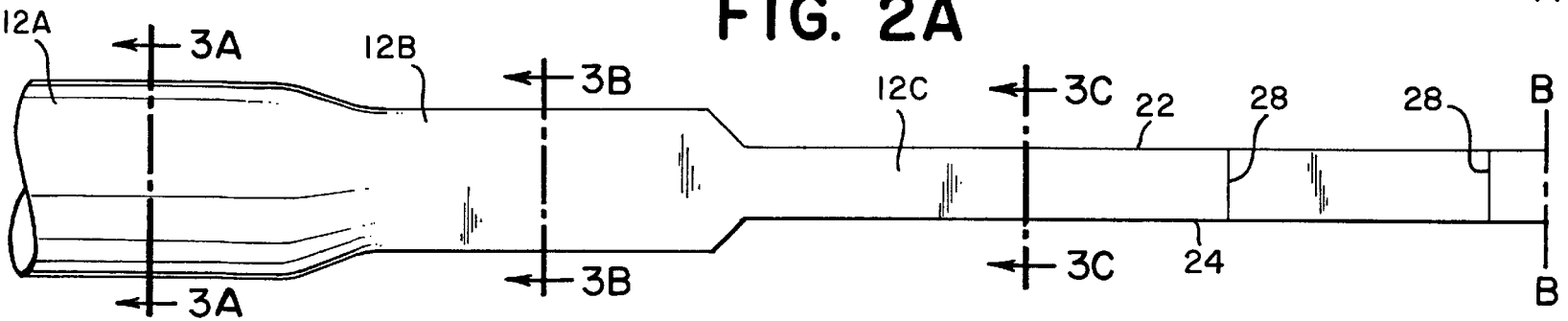
FIGS. 2A and 2B illustrate schematically the form of the plastic web at the various stations shown in FIGS. 1A and 1B.
Figure 1B:
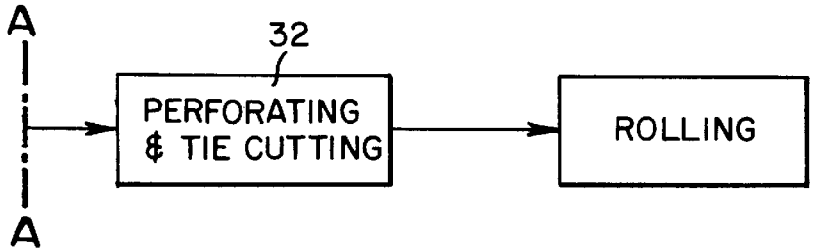
Figure 2B:
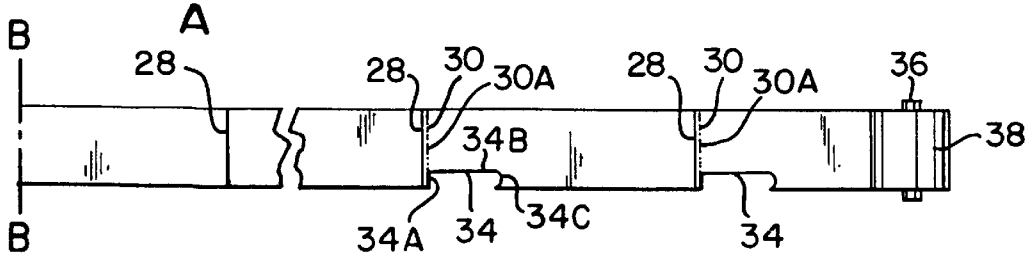

FIGS. 1A and 1B show diagrammatically the steps in the manufacture of refuse bags in accordance with the preferred embodiment of the invention; FIGS. 2A, 2B and FIGS. 3A, 3B and 3C show the form of the plastic web at each stage in the process.

Referring to these figures, an extrusion machine 10 produces a hollow tubular plastic form 12A. In the case of a refuse bag, high density polyethylene film may be extruded to a thickness of about 10 to 25 microns; however, the selection of materials and dimensions form no part of this invention.

The hollow tubular form 12A from the extrusion machine is then passed through a gussetting station 14 in which it is fully gussetted as shown at 12B, forming two inner folds 16 and four outer folds 18 (FIG. 3B).

The fully gussetted tube 12B is then fed to a folding station 20 where it is folded in half to form an eight-ply web 12C with one longitudinal edge 22 formed by the fold in the web and the other longitudinal edge 24 defined by the four outer folds 18 formed in the gussetting step.

After the fully gussetted web has been longitudinally folded, the eight layer web 12C is fed to a conventional sealing or welding station 26 to form linear welds or seals 28 which bond all eight layers together and which serve as the bottoms of the bags. Perforated separation lines 30 are then cut into the web with slot 30A in the center of each separation line at a perforation and tie-cutting station 32. As explained in U.S. Pat. No. 5,558,262, the slot in the perforation line is intended to be engaged by a tongue in a dispenser so that individual bags can be dispensed one at a time. Bags formed in this fashion are known as "star seal" bags.

In accordance with the invention, a small elongated tie cut-out region 34 is cut into each of the individual bags in the region immediately beneath the perforated separation line 30 at the perforation and tie-cutting station 32. The tie cut-out region 34 can be formed in either edge of the bag, i.e. either the longitudinal fold 22 or the four fold edge 24. It is preferred that the cut-out region 34 be formed in the four fold edge 24 because it is easier to cut accurately on that edge. This is because the distance between the inside fold 16 and the edge 22 after the web is folded may be variable, whereas the folds 18 are relatively closely aligned after folding. Consequently, a narrower cut can be made in the four fold edge 24 than in the longitudinal fold 22. Each region includes a short edge 34A coincident with a separation line 30, a longitudinal edge 34B and a bottom edge 34C in the form of an arc.

After the bags have been formed with the tie cut-out regions 34, the web is rolled on a core 36 to form a roll of bags 38. Core 36 is slightly longer than the width of the plastic web so that the core can be supported in a dispensing device to facilitate the dispensing of the bags, one by one.

A roll may contain one hundred (for example) plastic bags. After the requisite number of bags has been wound on a core 36, the web is cut, the roll 38 removed and the moving web wound on another core 36. The entire process is continuous; that is the tube is gussetted, folded, sealed, perforated, die cut and rolled as the web moves continuously from the extrusion machine through the various stations shown in FIGS. 1A and 1B.

The bags are preferably dispensed with the perforation lines 30 behind the seals 28 so that as each bag is dispensed, the bag which becomes the leading bag has its open end in front. The bags can be dispensed by any device which includes a tongue capable of engaging the slots 30A in the separation lines. For example, the device shown in U.S. design Pat. No. 409,027 may be used.

FIG. 4 illustrates a bag in accordance with the invention after it has been separated from the roll 38 and opened. Because of the cut-out regions 34 (shown in phantom in FIG. 4), four flaps or ties 40 are formed at the top of the bag. The length and width of the ties 40 will, of course, depend on the dimensions of the cut-out regions 34. The ties 40 are separated by adjacent cut-out regions 34. After the bag has been filled, the ties 40 can be tied together to secure the contents of the bag.

The arc 34C is important for two reasons. First, it avoids a sharp corner at its junction with the longitudinal edge 34B which would be more likely to tear if subject to stress. Secondly, because of the shape of the arc, the presence of a "valley" in the cut-out region when it is opened (as explained below) is avoided. With the shape shown in FIG. 4, a slight peak 42 is formed in the open bag but that does not enhance the likelihood of tearing. On the other hand, a valley, i.e. a V-shaped region, would be more likely to tear at the apex or point of the "V".

There are a number of ways in which the tie cut-out regions can be formed. In a preferred embodiment, a die 44 (FIGS. 5 and 6) is attached to the perforation blade 46 which is used to form the separation lines 30. Perforation blade 46 includes teeth 48 which form the perforations, and elongated teeth 50 and 52 which form the slot 30A and the upper edge 34A of cut-out region 34, respectively. The cutting edge 44A of die 44 is shaped to form the longitudinal edge 34B and the arc 34C of the cut-out region 34.

As shown in FIG. 6, the blade 46 and die 44 are moved vertically just after a seal 28 in the moving web has passed the blade. The mechanism for actuating and moving the blade is conventional and, therefore, is not described in detail.

Figure 7:
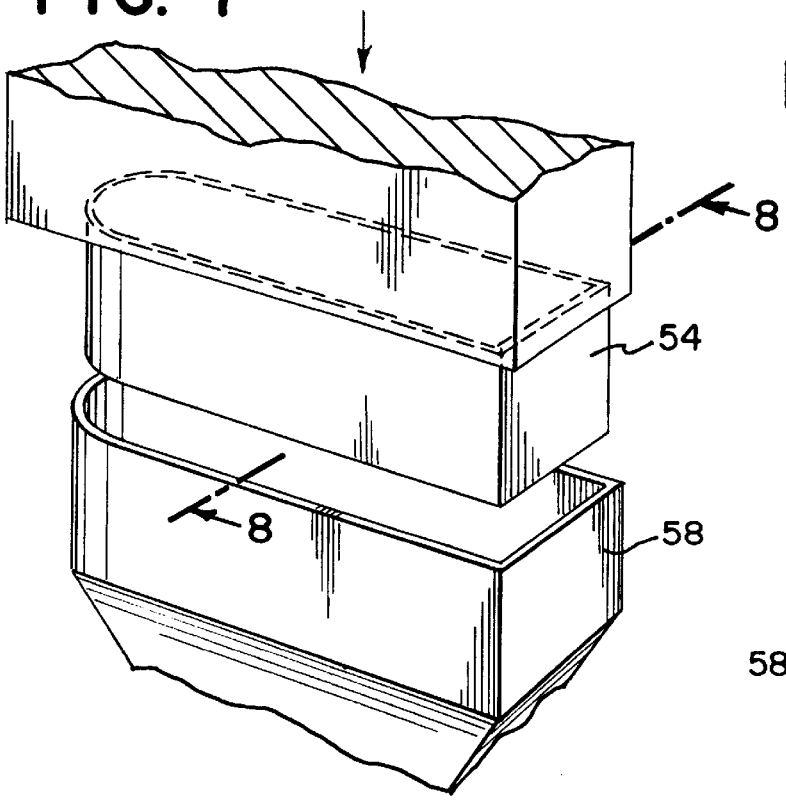
FIG. 7 is a perspective view of a different mechanism which can used to form the tie cut-out regions.
Figure 8:
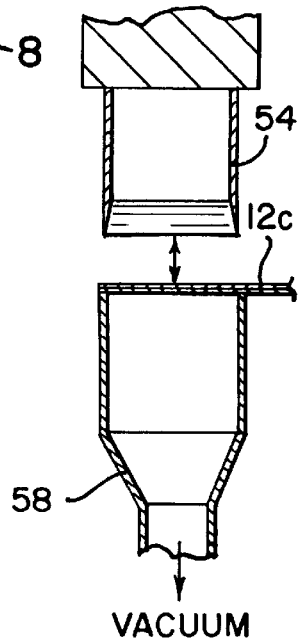
FIG. 8 is a side sectional view of the tie cutting mechanism of FIG. 7.
Figure 9:
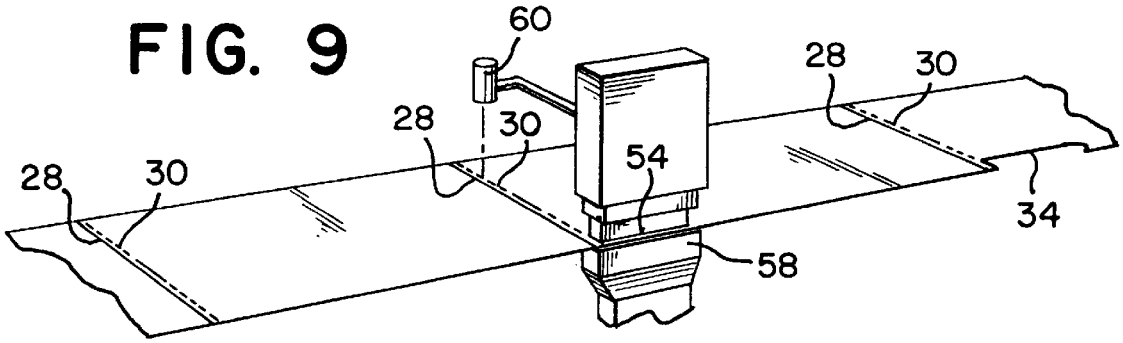
FIG. 9 is a perspective view showing the tie cutting mechanism of FIGS. 7 and 8 in its operating position relative to a moving web.

It is also contemplated that the cut-out region 34 may be die cut after the perforation line 30 has been formed. For example, if the perforation line is formed by a rotary perforation blade, a male punch 54 may cooperate with a fixed female die 58 (FIGS. 7, 8 and 9). The timing of the die cutting operation can be based on a sensing device 60 which optically detects the perforation line. If a rotary perforation blade is used, the timing and functioning of the male die may be actuated directly by the blade itself.

Figure 10:
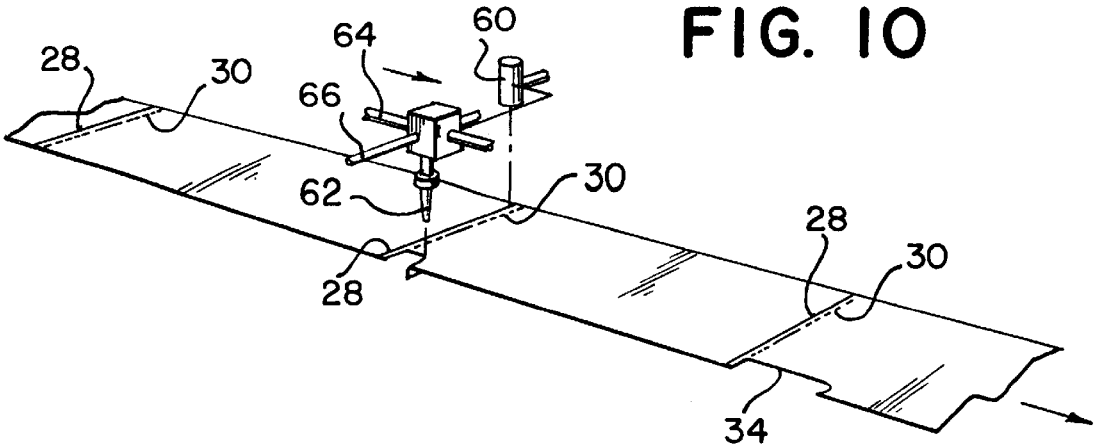
FIG. 10 is a perspective view of a water jet cutting device which can be used to form the tie cut-out regions.

A pressurized water jet 62 (FIG. 10) may also be used to remove the tie cut-out area. In this case, the water jet nozzle 62 is moveable longitudinally on a first rail 64. The entire assembly is moveable laterally on a second transverse rail 66. The apparatus for moving the nozzle may be conventional. The movement of the nozzle both longitudinally and laterally is synchronized with the device which cuts the perforation line to cause the nozzle 62 to trace a line which defines the cut-out region 34. The nozzle must be capable of moving longitudinally at a speed greater than the speed of the web so that it can cut the arc 34C at the bottom of the cut-out region.

Obviously, the size and shape of the cut-out region can vary depending on circumstances. In the case of refuse bags made of high density polyethylene, the individual bags may be thirty inches long and the star seal web six inches wide. The cut-out region 34 may be ¼ to ½ inch wide and four to five inches long. In the illustrated embodiment, the cut-out regions are literally cut-out prior to rolling the web, but instead of physically removing the tie cut-out regions, they may be separated from the bag by means of a perforated separation line, in which case the user would have the option of removing the cut-out region prior to use. If the cut-out regions are not removed, the capacity of the bag is enhanced although the problem with closure is not satisfied.

In the preferred embodiment a star seal configuration is used, but the principles of the invention can be applied to other types of bags. For example, if a bag is fully gussetted (but not folded to form a star seal configuration), cut-out regions formed in one or both longitudinal edges would provide a useful result. If a flattened tube alone were used, it would be necessary to form tie cut-out regions in both edges. Although the provision of integral means for tying a bag is of particular utility in the case of a refuse bag, the invention is not limited to refuse bags and would have utility in any situation where it may be desirable to provide a means for tying a bag after it has been filled.

What is claimed is:

1. A roll of plastic refuse bags, comprising a fully gussetted tubular form folded longitudinally to form a star seal configuration in which one longitudinal edge is a single longitudinal fold and the other longitudinal edge comprises four gusset folds, the bags being separated by straight separation lines which form the open ends of the bags and seals which form the closed ends of adjacent bags, each separation line including a slot for engaging a tongue to separate the leading bag from the roll of bags, wherein a tie cut-out region is removed from each bag in at least one of the longitudinal edges behind the separation line so that when a bag is separated from the roll and opened, four ties are formed which can be used to tie the bag closed, said ties being unconnected to each other at their upper ends.

2. A roll of plastic refuse bags according to claim 1 wherein the tie cut-out regions are formed in said one longitudinal edge only.

3. A roll of plastic refuse bags according to claim 2, wherein said tie cut-out region is removed from the edge which comprises four gusset folds.

4. A roll of plastic bags, comprising a fully gussetted tubular form containing a multiplicity of bags, with adjacent bags separated from each other by a seal line and a straight separation line behind the seal line, and at least two tie cut-out regions removed from each bag behind the separation line so that when an individual bag is separated from the roll and opened, at least two ties are formed which can be used to tie the bag closed, said ties being unconnected to each other at their upper ends.

* * * * *